US005487473A

United States Patent [19]

Ford

[11] Patent Number: 5,487,473

[45] Date of Patent: Jan. 30, 1996

[54] BELT RACK VENDING FIXTURE

[75] Inventor: Allan L. Ford, Melrose Park, Pa.

[73] Assignee: Reborn Products Co., Inc., Bensalem, Pa.

[21] Appl. No.: 108,352

[22] Filed: Aug. 18, 1993

[51] Int. Cl.[6] ..... A47F 7/00

[52] U.S. Cl. ..... 211/59.1; 211/60.1; 211/181

[58] Field of Search ..... 211/59.1, 57.1, 211/60.1, 163, 106, 181; 40/642

[56] References Cited

U.S. PATENT DOCUMENTS

| | | | |
|---|---|---|---|
| D. 179,891 | 3/1957 | Flannery . | |
| D. 326,570 | 6/1992 | Heilman . | |
| 1,137,900 | 5/1915 | Reichert . | |
| 1,292,314 | 1/1919 | Hays . | |
| 3,202,297 | 8/1964 | Hardy . | |
| 3,978,593 | 9/1976 | Pulitzer et al. . | |
| 4,072,246 | 2/1978 | Paulin | 211/59.1 X |
| 4,253,576 | 3/1981 | Ford et al. | 211/59.1 X |
| 4,591,057 | 5/1986 | Garfinkle | 211/59.1 |
| 4,750,627 | 6/1988 | Myers . | |
| 4,936,565 | 6/1990 | Fredrickson | 211/59.1 |

*Primary Examiner*—Robert W. Gibson, Jr.
*Attorney, Agent, or Firm*—Caesar, Rivise, Bernstein, Cohen, & Pokotilow, Ltd.

[57] ABSTRACT

A belt fixture comprising a frame supporting plural racks therefrom. Each of the racks is arranged for displaying and vending plural belts of a respective style, with belts of each of the styles being in plural groups of different sizes, and with the number of belts in each group being directly proportional to the popularity of belts of that size. Each of the racks comprising a pair of elongated, spaced-apart rods, and a plurality of elongated prongs projecting perpendicularly thereto. Each rack is supported from the frame by respective threaded fasteners extend between the rods. Each of the projecting prongs is arranged to suspend a respective group of belts therefrom and is of a length directly proportional to the number of belts in the group so that when that group of belts is suspended from the rod the rod appears full. A slidable, color coded strip is mounted on each rack to indicate the style of belts on that rack and the size(s) of the belts of the group suspended by the various prongs of that rack.

16 Claims, 2 Drawing Sheets

FIG. 1
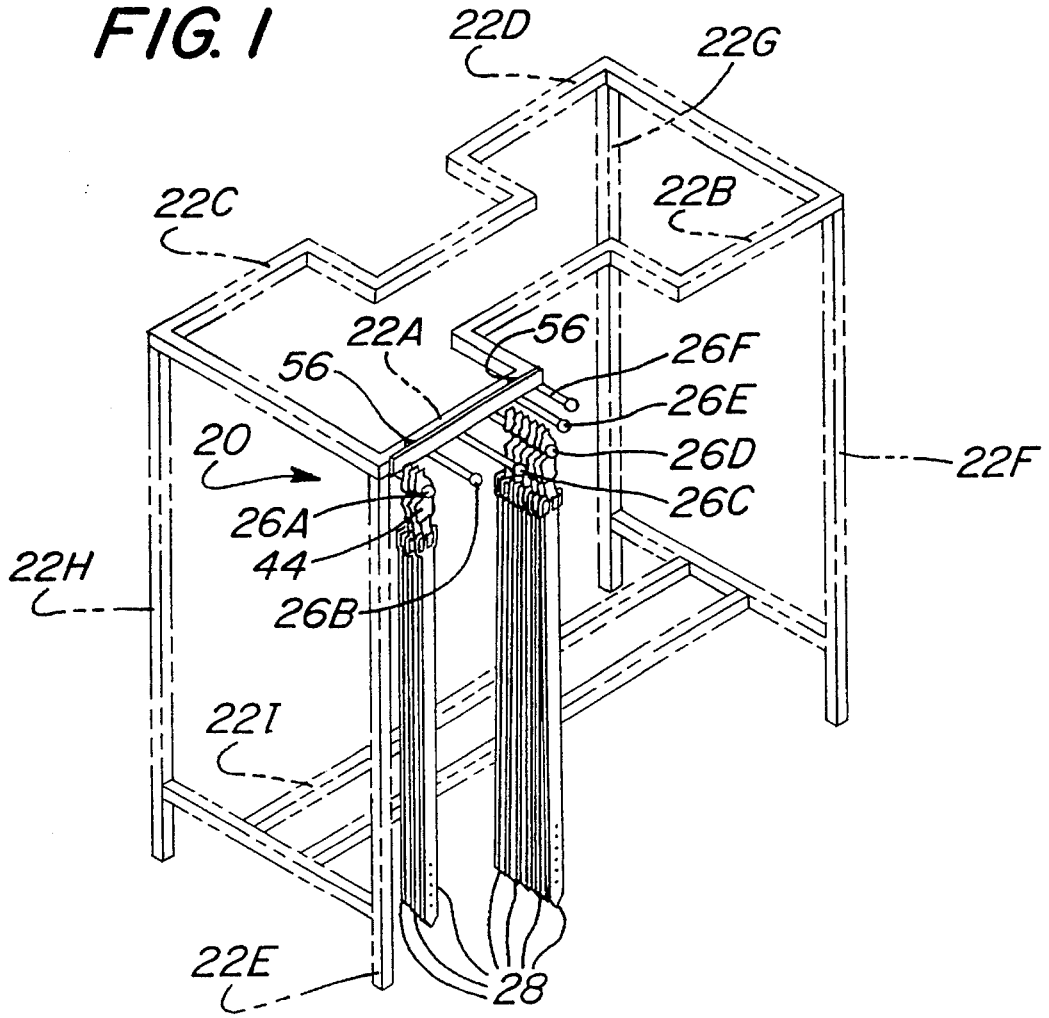
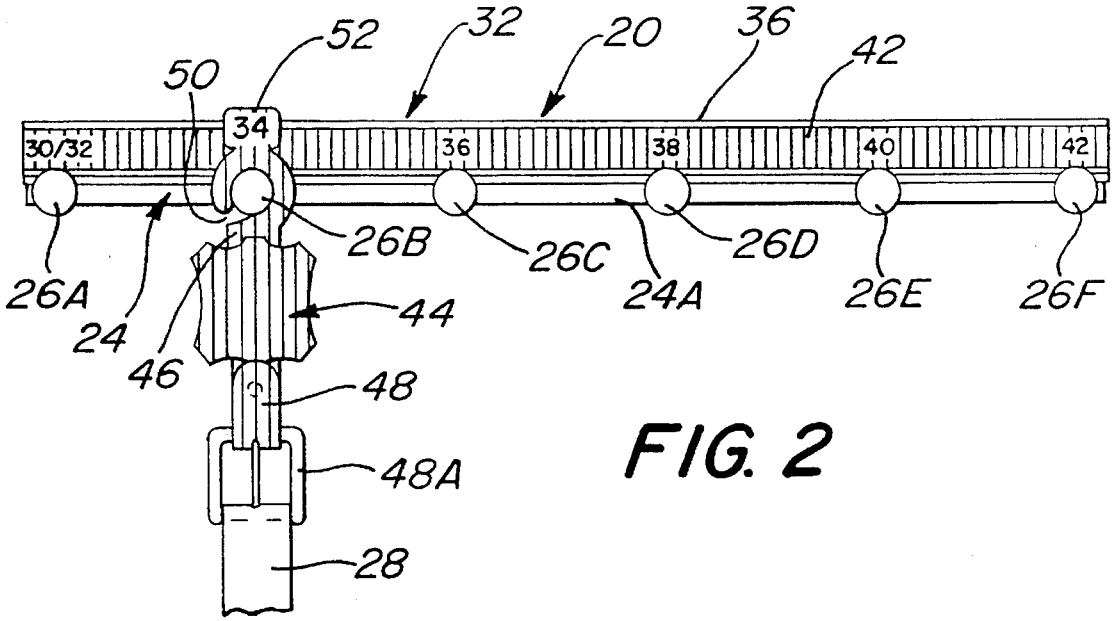
FIG. 2

BELT RACK VENDING FIXTURE

BACKGROUND OF THE INVENTION

This invention relates generally to display fixtures, and more particularly to racks for displaying and vending plural belts.

Belts are commonly vended by suspending them from belt racks. Generally, the belts are arranged on the racks by size, with various styles of belts being co-mingled within a given size. The advantage of displaying belts on a rack, as opposed to packaging them in boxes, is that a customer can view the entire belt and try it on without the necessity of having to remove it from a box, and possibly not replace it in the box when placing it back on a counter.

One of the problems of utilizing earlier types of belt racks is that quite often customers will remove the belt from its suspending bar, and replace the belt on a different bar. Quite often, the belt is not replaced with belts of a similar size. This creates a major problem for a store attempting to maintain inventory of given sizes and styles, and in addition, prevents a customer from noticing that a belt in his size is available, since he/she will only look at belts on the portion of the rack containing his/her size. That problem has been obviated by my earlier invention which is the subject of U.S. Pat. No. 4,253,576, which is assigned to the same assignee as this invention, and whose disclosure is incorporated by reference herein.

That invention comprises a fixture supporting plural belt racks thereon for display and vending. That fixture makes use of a color coding system for the belts. In particular, by utilizing the color coding system, all of the belts that are on display are provided with a color code which separates belts as to size. For instance, all small belts will be coded brown, all medium belts will be coded yellow, all large belts will be coded red and all extra-large belts will be coded green. In this way, the store can maintain the integrity of the sizes by arranging the belts in their proper colors.

The one problem remaining with the aforementioned coding system per se is that there is no way of segregating the belts as to style. Thus, sport belts, dress belts, fabric belts, etc. will all be co-mingled under a given size. This creates an inconvenience for the customer who is only looking for a particular style of belt. Furthermore, the store has no ready way of maintaining inventory between different styles because all of the styles are co-mingled within a given size range. The store can accordingly have twelve belts of one style in a given size while having only one belt of a different style in the same size.

The fixture of my aforementioned patent also overcomes this problem by providing a belt rack comprising a plurality of sections, with each of said sections having indicia thereon, said indicia comprising a different color for each section, each section having a plurality of spokes thereon and a plurality of hang tags for suspending belts from the spokes, with each hang tag in a given section having the same color as the color indicium of said section, with said colors being used to separate the belts by style.

Prior art belt vending racks, even those constructed in accordance with my aforementioned patent, have made use of plural prongs, each of the same length, for suspending belts of a given size therefrom. As is known by those skilled in the belt merchandizing art that there is a lower demand for very small and very large sizes, e.g., "men's" 30"/32" and 42", respectively, while there is a larger demand for slightly larger and slightly smaller sizes, e.g., "men's" 34" and 40", respectively. The largest demand is for the intermediate sizes, e.g., "men's" 36" and 38". Thus, it is a common practice for merchandisers to keep a larger inventory of the more popular sizes and a smaller inventory of the less popular sizes. That being the case, where there is only a small inventory of unpopular sizes on hand and which are suspended from some of the fixture's prongs, the fixture will appear less than full, i.e., the prongs suspending the more popular sizes will appear full. This partially unfilled appearance is unpleasing aesthetically and commercially, and thus can have a detrimental effect from a marketing standpoint.

Hence, a need presently exists to provide a fixture for racks of belts so that they may be vended in such a way that there appears to be a full inventory of all sizes, even though there are less belts on the racks for the less popular sizes and more belts on the rack to the more popular sizes.

OBJECTS OF THE INVENTION

Accordingly, it is a general object of this invention to provide a rack for displaying and vending belts which overcomes the disadvantages of the prior art.

It is another object of this invention to provide a rack for displaying and vending belts and which is constructed to provide a full appearance, notwithstanding the fact that the rack include plural groups of belts, with the number of belts in any group being a function of the belt's popularity.

It is another object of this invention to provide a rack for displaying and vending belts and which is arranged to be readily mounted on a fixture or other support.

It is another object of this invention to provide a fixture having plural belt racks supported thereon, each rack being adapted to suspend groups of plural belts from respective prongs thereof, with the number of belts in each group being a function of the popularity of the size of said belt.

It is another object of this invention to provide a fixture having plural belt racks supported thereon, each rack being adapted to suspend plural belts of a given style therefrom for display and vending.

SUMMARY OF THE INVENTION

These and other objects of this invention are achieved by providing a rack for displaying and vending plural belts from a fixture or other support. The belts being displayed for vending by the rack are in plural groups of different sizes, with the number of belts in each group being directly proportional to the popularity of belts of that size.

The rack basically comprises a base and a plurality of prong members. The base comprises at least one elongated member from which the plurality of prong members project outward, and is arranged for mounting the rack onto the fixture or other support. Each of the projecting prong members is arranged to suspend a respective group of belts therefrom and is of length directly proportional to the number of belts in the group so that when the group of belts is suspended from the prong member the prong member is full.

In accordance with one preferred aspect of the invention the rack includes size indicating means bearing indicia representing the size of the belts in each of the groups located adjacent the prong members suspending the belts of the groups. The size indicating means may be color coded so that the rack may be readily filled with belts of a given style.

DESCRIPTION OF THE DRAWINGS

Other objects and many attendant features of this invention will become readily appreciated as the same becomes better understood by reference to the following detailed description when considered in connection with the accompanying drawings wherein:

FIG. 1 is a isometric view of a belt rack constructed in accordance with this invention shown mounted on a conventional frame fixture (with the fixture being depicted by phantom lines);

FIG. 2 is a front elevational view of the belt rack of FIG. 1 showing one of its prongs suspending plural belts of a given size therefrom;

DETAILED DESCRIPTION OF THE PREFERRED EMBODIMENTS

Figure 3:
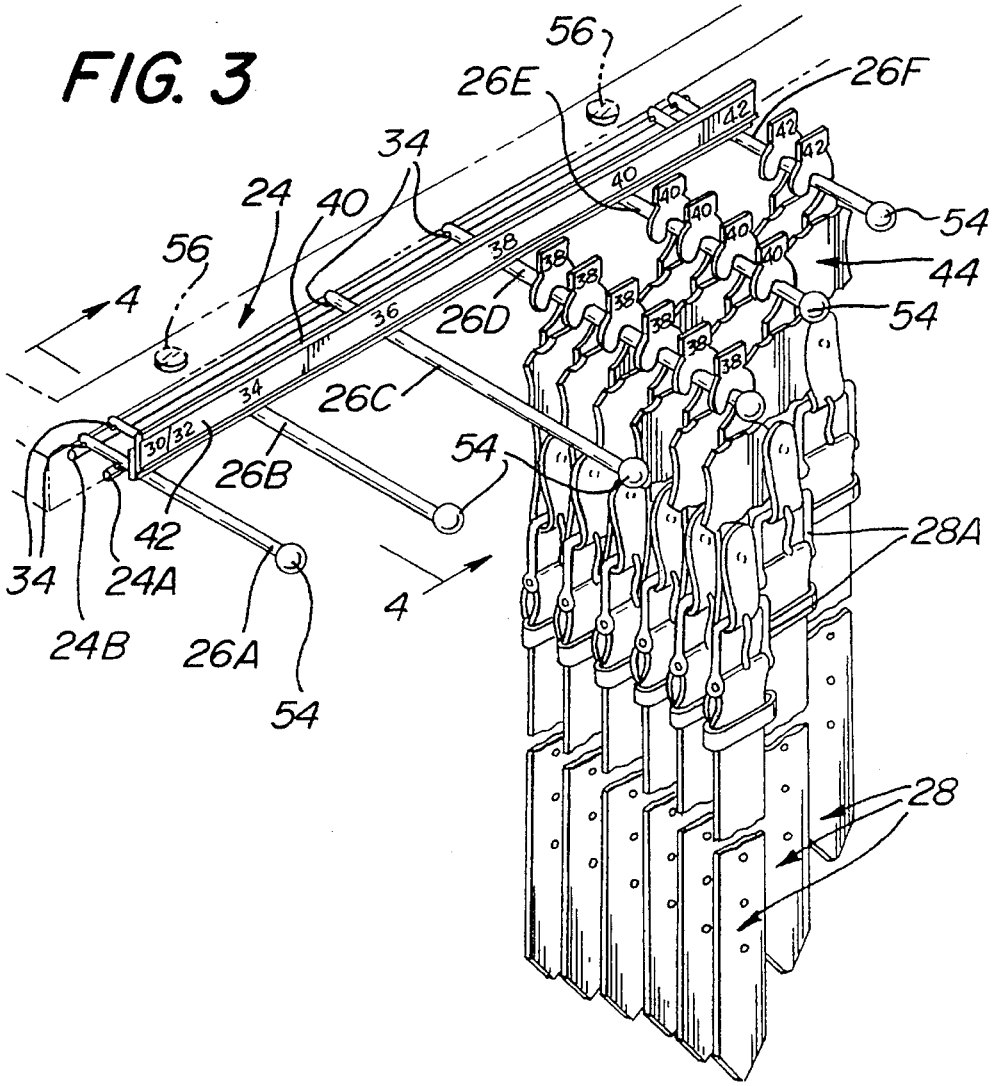
FIG. 3 is an enlarged isometric view of the belt rack shown in FIG. 1 with half of its prongs having belts suspended therefrom.

Referring now to various figures of the drawing where like reference numerals refer to like parts there is shown at 20 in FIG. 1, a rack for displaying and vending belts constructed in accordance with this invention. The rack is shown mounted on a one frame-like section, to be described hereinafter, of conventional fixture 22. The fixture 22 depicted by phantom lines in the figures of the drawing of this application.

It should be pointed out at this juncture that the fixture can be of any suitable construction for supporting one or preferably plural racks 20 therefrom. In the embodiment shown herein the fixture is a frame like construction including a plurality of interconnected square, hollow tubular sections 22A, 22B, 22C, and 22D, which are secured together. Each of these sections is arranged to have mounted thereon a respective rack 20 (although only one is shown). The plural racks which are mounted and supported by the fixture 22 are identical in construction, except that each rack includes different colored indicia means (to be described later) to indicate that each of the belts suspended from that rack are of the same style.

As will be described later each rack 20 includes plural elongated prongs extending therefrom, and from which plural groups of plural belts are suspended via respective hang tags. The interconnected sections 22A–22D of the frame 22 are supported by four tubular vertically extending leg sections 22E, 22F, 22G, and 22H so that the racks 20 are substantially above the floor so that the belts which are suspended from the rack's prongs do not touch the ground. The legs of the fixture 22 are braced adjacent their lower ends by a tubular bracing section 22I.

Figure 4:
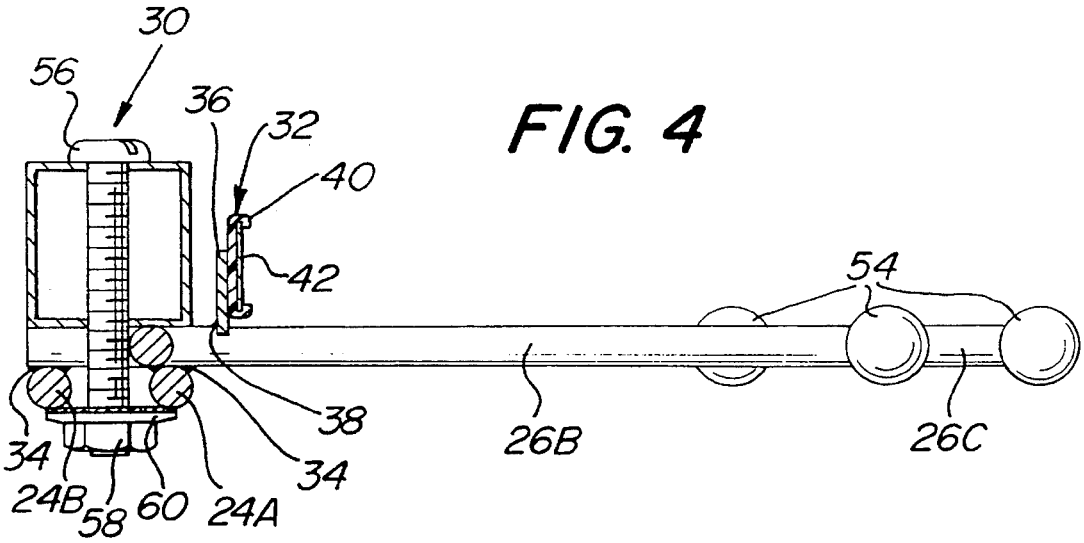
FIG. 4 is an enlarged sectional view taken along line 4—4 of of FIG. 3.

Referring now to FIGS. 2, 3, and 4, the details of the rack 20 will now be described. As can be seen therein the rack 20 basically comprises a base support 24 (FIG. 2) mounting a plurality of elongated prong members 26A, 26B, 26C, 26D, 26E, and 26F for suspending belts 28 therefrom, mounting means 30 (FIG. 4) for mounting the rack 20 on the desire frame section, e.g., 22A, of the fixture 22, and belt size and belt style indicating means 32 (FIGS. 2 and 3). The base member 24 basically comprises a pair of elongated rods 24A and 24B which extending parallel to each other. The prongs 26A–26F are each elongated rods which lie across the rods 24A and 24B so that their free ends extend outward perpendicularly to the rods 24A and 24B. The rods forming the prongs are fixedly secured, e.g., welded at 34 (FIG. 4), to the rods 24A and 24B forming the base at their various intersection points. The prongs 26A–26F thus project outward from the base and all lie in a common plane (See FIG. 4).

The size and style indicating means 32 basically comprises an elongated planar strip or plate 36 which extends along and parallel to the base member rod 24A and is fixedly secured, e.g., welded at 38, to each of the prongs 26A–26F so that it is held securely in place. An elongated channel member 40 extends along and is fixedly secured by any suitable means, not shown, to the plate 36. An elongated display card in the form of a strip 42 of material, e.g., cardboard, plastic, wood, metal, etc., of a predetermined color, e.g., yellow, indicating a particular style of belt, is releasably slidably mounted within the channel member 40. The display card 42 also bears plural numerical indicia thereon which serves to indicate the size of the belts supported on each of the prongs. In particular, as can be seen in FIGS. 2 and 3 the display card 42 includes indicia "30/32" at the leftmost end thereof. This indicia is arranged to be aligned with the prong 26A, when the strip 42, is in place in the channel member 40, to indicate that the belts 28 which are suspended from the prong 26A are either 30" or 32" in length. The display card includes indicia "34" spaced slightly to the right of the indicia 30/32 (as seen in FIGS. 2 and 3) and which is aligned with the prong 26B to indicate that the belts 28 which are suspended from that prong are 34" in length. Indicia "36" are provided on the display card spaced slightly to the right of the indicia "34". This indicia is aligned with the prong 26C to indicate that the belts which are suspended from that prong are 36" in length. The display card also includes indicia "38" located spaced slightly to the right of the indicia "36" and aligned with the prong 26D to indicate that the belts which are suspended from that prong are 38" in length. Indicia "40" are provided on the display card spaced slightly to the right of the indicia "38" and aligned with the prong 26E to indicate that the belts which are suspended from that prong are 40" in length. Finally the display card includes indicia "42" spaced slightly to the right of the indicia "40" and aligned with the prong 26F to indicate that the belts which are suspended from that prong are 42" in length.

In accordance with a preferred embodiment of this invention the length of the prongs 26A–26F which project beyond the front of the indicia strip 42 are of predetermined, different lengths. In particular, the length of each prong is preferably directly proportional to the number of belts in the group of belts suspended from that prong so that when that group of belts is suspended the prong appears full.

As can be seen clearly in FIG. 3 the prongs 26A–26F are arranged in increasing length order from the ends of the elongated base 24 inward toward the center of the base. In particular, the rack 20 comprises two end prongs, namely, prongs 26A and 26F, two intermediate prongs, namely, prongs 26B and 26E, and two center prongs, namely, 26C and 26D. In accordance with a preferred embodiment the length of the end prongs 26A and 26F are approximately 60% of the length of the center prongs 26C and 26D, while the length of the intermediate prongs 26B and 26E are approximately 80% of the length of those center prongs.

The end prong 26A is arranged for suspending belts of sizes 30 and 32 therefrom and the end prong 26F is arranged for suspending belts of size 42 therefrom. The leftmost (as view in FIG. 3) intermediate prong 26B is arranged for suspending belts of size 34 therefrom and the intermediate prongs 26E is arranged for suspending belts of size 40 therefrom. The leftmost center prong 26C is arranged for suspending belts of size 36 therefrom and the center prong 26D is arranged for suspending belts of size 38 therefrom.

Each of the belts 28 making up each size group are releasably mounted on the associated prong through the use of a respective hang tag 44. Each hang tag is of a conventional construction and basically comprises a head 46 and an integral dependent strap 48. The strap 48 is an elongated member which is arranged to be extended through the buckle 48A (FIG. 2) of the belt and bent back on itself and snap connected to itself to releasably suspend the belt 28 therefrom. The head 46 of the hang tag 44 includes a slot 50 for receipt of a prong 26A–26F to suspend the hand tag (and the belt connected thereto) from that prong.

As is conventional the head of the hand tag may include an upstanding projection 52 (FIG. 2) bearing indicia indicating the size of the belt suspended from that hang tag. For example in FIG. 2 the hang tag shown has a projection 52 bearing the indicia "34" to indicate that the belt 28 suspended therefrom is size 28.

Preferably, each hang tag is molded from a substantially rigid, slightly flexible plastic.

In order to prevent the hang tags and the belts suspended therefrom from accidentally sliding off the free end of the prong upon which they are suspended, each prong includes a bulbous free end 52.

The racks 20 are each mounted onto their respective tubular sections of the fixture 22 by the heretofore identified mounting means 30. As can be seen in FIGS. 1 and 4 that means basically comprises a pair of threaded bolts 56 and an associated pair of threaded nuts 58 (FIG. 4) and washers 60 (FIG. 4). The bolts extend through holes in the tubular section of the fixture 22 to which the rack 20 is to be mounted, with the heads of the bolts 56 lying on the top surface of that tubular section. The bolts extend out of the bottom surface of the tubular section and through the space between the elongated rods 24A and 24B making up the rack's base 24. The top surfaces of those rods engage the bottom surface of the tubular frame. A respective nut 58 is then threadedly engaged on the lower end of each bolt 56, with a respective washer 60 interposed between the nut and the rods 24A and 24B, and the nut tightened to secure the rack onto the fixture.

Once a belt 28 has been secured in place on its hang tag 44, the belt can then be placed on its appropriate prong on an appropriate rack 20. This is accomplished by first determining the style of the belt so that the belt can be placed on the rack for all other belts of that style. This is readily determined by comparing the color of the hang tag 44 with the colors of the display panels 42 of the various racks 20. Thus, there will be a separate colored hang tag for each style of belt and a correspondingly colored display panel 42 on a rack 20 for suspending that belt. For instance, if the belt is a reversible belt, the hang tag may be yellow. The hang tag is placed on the belt by the manufacturer of the belt. The person filling the rack in a store will simply look at the color of the hang tag, and noting that it is yellow, will place the belt on the prong for the appropriate size of the belt on the rack 20 having a yellow colored display panel 42. Thus, if the belt is size 34 it will be suspended by its hang tag 44 from the prong 26B of the rack 20 having the yellow display panel 42. Belts of other styles, such as those suspended by brown hang tags, are mounted on the rack having the brown display panel, according to their sizes in the same manner as described heretofore. All the other belts are added to the racks in a similar manner.

When all the racks are filled with belts the fixture 22 has a full, aesthetically pleasing appearance, even though there will be more belts of the more popular sizes than of the less popular sizes since the prongs supporting the less popular size belts are shorter in length than the more popular size belts. Accordingly, with the subject invention a merchandiser does not have to stock unnecessarily large quantities of less popular sizes of belts to ensure that the display appears full.

When a retailer desires to restock the fixture 22, he/she will first be certain that all of the hang tags are placed in their appropriate racks. Thus, all yellow hang tags should be placed on the rack formed by the display panel 42 having the color yellow thereon. He/she will go through the same routine with the other colors of the other racks to be certain that all of the belts of a given style are placed on their proper racks and grouped in accordance with their sizes. Once the arrangement has been carried out, the store owner can then readily determine the number of belts in each size for each style, and can readily restock each rack. Furthermore, he/she can obtain a ready inventory of each size of each style of belt. The entire process of arranging the display, taking an inventory and restocking the display can be carried out in a very short period of time, e.g., less than ten minutes.

The fixture 22 and its component racks 20 is highly attractive, particularly, with the different colored strips on the display panels. The rack can be made of any decorative material known to the art, although it is preferred that it be made of chrome-plated steel, in view of the attractiveness and durability of this material.

Without further elaboration the foregoing will so fully illustrate my invention that others may, by applying current or future knowledge, adapt the same for use under various conditions of service.

I claim:

1. A rack for displaying and vending plural belts, said belts being in plural groups of different sizes, with the number of belts in each group being directly proportional to the popularity of belts of that size, said rack comprising a base and a plurality of prong members, said base comprising at least one elongated member from which said plurality of prong members project outward, said elongated member including a pair of ends and a center, said base being arranged for mounting the rack onto a support, each of said prong members being arranged in increasing length order from the ends of said elongated member inward to said center and being of length directly proportional to the number of belts in the group suspended therefrom, so that when said group of belts is suspended therefrom said prong member is full.

2. The rack of claim 1 wherein said rack comprises two end prong members, two intermediate prong members and two center prong members.

3. The rack of claim 2 wherein the length of the end prong members and intermediate prong members is approximately 60% and 80% of the length of the center prong members.

4. The rack of claim 3 wherein one of said end prong members is arranged for suspending belts of sizes 30 and 32 therefrom and the other of said end prong members is arranged for suspending belts of size 42 therefrom, wherein one of said intermediate prong members is arranged for suspending belts of size 34 therefrom and the other of said intermediate prong members is arranged for suspending belts of size 40 therefrom, and wherein one of said center prong members is arranged for suspending belts of size 36 therefrom and the other of said center prong members is arranged for suspending belts of size 38 therefrom.

5. The rack of claim 1 additionally comprising size indicating means bearing indicia representing the size of the belts in each of said groups located adjacent the prong members suspending the belts of said groups.

6. The rack of claim 5 wherein said size indicating means comprises an elongated plate releasably securing an elongated strip thereto, said elongated strip bearing said indicia.

7. The rack of claim 6 wherein said elongated strip is slidably mounted within said elongated plate.

8. The rack of claim 6 wherein said elongated strip is of a predetermined color to indicate a particular style of belt.

9. The rack of claim 1 wherein each of said prong members includes a free end, said free end including stop means thereat to prevent the belts in the group suspended therefrom from accidentally sliding off said prong member.

10. The rack of claim 1 wherein said base comprises a pair of elongated rods extending parallel to each other, with said prong members being elongated linear members extending generally perpendicularly to said rods.

11. The rack of claim 10 additionally comprising size indicating means bearing indicia representing the size of the belts in each of said groups, said size indicating means comprises an elongated plate extending parallel to said rods and releasably securing an elongated strip thereto, said elongated strip bearing said indicia.

12. The rack of claim 11 wherein said elongated strip is slidably mounted within said elongated plate.

13. The rack of claim 10 additionally comprising releasably securable means for location between said rods to mount said rack on a support frame.

14. A belt fixture for displaying and vending belts, said fixture comprising a frame supporting plural racks therefrom, each of said racks for displaying and vending plural belts of a respective style, said belts of each of said styles being in plural groups of different sizes, with the number of belts in each group being directly proportional to the popularity of belts of that size, each of said racks comprising a base and a plurality of prong members, said base comprising at least one elongated member from which said plurality of prong members project outward, said base being arranged for mounting said rack onto a support, each of said prong members being arranged to suspend a respective group of belts therefrom and being of length directly proportional to the number of belts in the group suspended therefrom so that when said group of belts is suspended therefrom said prong member is full, each of said racks additionally comprising size indicating means bearing indicia representing the size of the belts in each of said groups located adjacent the prong members suspending the belts of said groups, said size indicating means of each of said racks comprising an elongated plate releasably securing an elongated strip thereto, said elongated strip bearing said indicia and being of a respective predetermined color to indicate a particular style of belt.

15. The fixture of claim 14 wherein base of each rack comprises a pair of elongated rods extending parallel to each other, with said prong members being elongated linear members extending generally perpendicularly to said rods.

16. The fixture of claim 14 wherein each of said racks additionally comprising releasably securable means for location between said rods to mount said rack on said frame.

* * * * *